US007445644B2

(12) United States Patent
Song et al.

(10) Patent No.: US 7,445,644 B2
(45) Date of Patent: Nov. 4, 2008

(54) COMPOSITIONS CONTAINING ANIONICALLY MODIFIED CATECHOL AND SOIL SUSPENDING POLYMERS

(75) Inventors: Xinbei Song, Cincinnati, OH (US); Kevin Patrick Christmas, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 34 days.

(21) Appl. No.: 11/588,457

(22) Filed: Oct. 27, 2006

(65) Prior Publication Data

US 2007/0099815 A1 May 3, 2007

Related U.S. Application Data

(60) Provisional application No. 60/731,051, filed on Oct. 28, 2005.

(51) Int. Cl.

| | |
|---|---|
| ***B08B 3/04*** | (2006.01) |
| ***C11D 3/34*** | (2006.01) |
| ***C11D 3/37*** | (2006.01) |
| ***C11D 9/32*** | (2006.01) |

(52) U.S. Cl. ..... 8/137; 510/276; 510/302; 510/305; 510/320; 510/346; 510/351; 510/357; 510/360; 510/361; 510/426; 510/475; 510/495; 134/39; 134/42

(58) Field of Classification Search ..... 510/276, 510/302, 305, 320, 346, 351, 357, 360, 361, 510/426, 475, 495; 134/39, 42; 8/137
See application file for complete search history.

(56) References Cited

U.S. PATENT DOCUMENTS

| | | | | |
|---|---|---|---|---|
| 3,547,988 | A | 12/1970 | Bean | |
| 3,812,044 | A | 5/1974 | Connor et al. | |
| 3,864,286 | A | 2/1975 | Anderson | |
| 3,957,660 | A | 5/1976 | Kablaoui et al. | |
| 4,058,472 | A | 11/1977 | Kablaoui | |
| 4,595,736 | A | 6/1986 | Patel | |
| 4,687,592 | A | 8/1987 | Collins et al. | |
| 4,689,167 | A * | 8/1987 | Collins et al. | 510/299 |
| 4,814,110 | A | 3/1989 | Fong et al. | |
| 5,622,996 | A | 4/1997 | Fish | |
| 5,834,525 | A | 11/1998 | Fish | |
| 6,065,130 | A | 5/2000 | Glitho | |
| 6,350,921 | B1 | 2/2002 | Durairaj et al. | |

FOREIGN PATENT DOCUMENTS

| | | | |
|---|---|---|---|
| CN | 1425646 | A | 12/2002 |
| JP | 48017643 | | 5/1973 |
| JP | 55047382 | A | 4/1980 |
| JP | 63258806 | A2 | 10/1988 |
| JP | 63258804 | A2 | 2/1990 |
| JP | 4164017 | | 6/1992 |
| JP | 6065130 | A2 | 3/1994 |
| JP | 9100494 | A2 | 3/1999 |
| WO | WO-9605283 | | 2/1996 |
| WO | WO 2006/133773 | A1 | 12/2006 |

OTHER PUBLICATIONS

U.S. Appl. No. 11/588,712, filed Oct. 27, 2006, Scheibel et al.

* cited by examiner

*Primary Examiner*—Brian P Mruk
(74) *Attorney, Agent, or Firm*—Stephen T. Murphy; Laura R. Grunzinger; Kim William Zerby

(57) ABSTRACT

A cleaning composition utilizing an anionically modified catechol in combination with a soil suspending polymer to remove clay and plant-derived polyphenolic compound soils.

18 Claims, No Drawings

COMPOSITIONS CONTAINING ANIONICALLY MODIFIED CATECHOL AND SOIL SUSPENDING POLYMERS

CROSS REFERENCE TO RELATED APPLICATION

This application claims the benefit of Provisional U.S. Patent Application Ser. No. 60/731,051 filed Oct. 28, 2005.

FIELD OF THE INVENTION

The present invention relates to a composition comprising an anionically modified catechol and a soil suspending polymer.

BACKGROUND OF THE INVENTION

Cleaning of clay soils and soils containing plant-derived polyphenolic compounds (e.g. wine, grape juice, tea and grass) on surfaces continues to be a desired ability of cleaning compositions such as laundry detergents. The inclusion of polymers for soil removal and soil suspension has been utilized for the removal of soils from surfaces in cleaning composition. Often included in these cleaning compositions are surfactants.

Reductions in wash temperatures and reductions in levels of certain materials, such as surfactants, builders, and the like, in cleaning compositions, for environmental and cost saving measures, continue to demand more of a cleaning composition while formulating fewer or lower levels of materials.

Catechols have been discussed as being sequestering agents, or builders, in cleaning compositions. U.S. Pat. No. 3,864,286 discusses the use of disulfonated catechols as detergent builders and surfactants in heavy-duty cleaning compositions. U.S. Pat. No. 3,812,044 discusses the use of a water soluble salt of a polyfunctionally-substituted aromatic acid compound as a sequestering agent in cleaning compositions. U.S. Pat. No. 4,687,592 discusses a detergency builder system for cleaning compositions having ether polycarboxylates, iron and manganese chelating agent (polyfunctionally-substituted aromatic chelating agents among others) and a polymeric polycarboxylate dispersing agent. An alkyl modification to a disulfonated catechol is discussed in U.S. Pat. No. 4,058,472 for the use of alkali metal and ammonium salts of sulfonated $C_{12}$-$C_{18}$ alkylcatechols as a surfactant component of cleaning compositions.

Soil suspending polymers or dispersing agents have been utilized in laundry detergent applications. One type of soil these polymers are utilized for are clay soils. Clay soils comprise platelets that associate in face-to-face, edge-to-face or a mixture of the two orientations. The platelets contain aluminum ions ($Al^{3+}$), some ions being exposed along the edge of the platelet creating a positive charge density. Removal of the clay soils from the surfaces to which it is adhered is difficult to accomplish in relatively short time periods (under 1 hour) such as those found in standard laundry cycles. This is especially true at lower cleaning temperatures (60° C.). Soil suspending polymer do provide some removal of clay soils, however, such clay soils are often not completely removed from the surface. Therefore there still exists a need to improve clay soil removal from surfaces.

It has been unexpectedly discovered that the combination of an anionically modified catechol with a soil-suspending polymer provides improved clay soil cleaning. It has also unexpectedly been discovered that the combination of an anionically modified catechol with a soil-suspending polymer provides improved plant-derived polyphenolic compound soil cleaning in laundry and dishwash systems. These improvements in cleaning are also observed in compositions further comprising a surfactant or surfactant system along with the anionically modified catechol and the soil suspending polymer.

SUMMARY OF THE INVENTION

The present invention relates to a composition comprising: (a) a catechol having one or two sulfate groups; and (b) a water soluble soil suspending polymer. The present invention further relates to a method of removing clay soil or plant-derived polyphenolic compound soils from a surface or fabric comprising the steps of: (a) contacting a composition of claim 1, in neat or dilute form, with the surface or fabric; (b) rinsing the surface with water.

DETAILED DESCRIPTION OF THE INVENTION

As used herein "clay soil" means naturally-occurring particulates primarily made up of alumino-silicate of varying trace inorganic impurities and associated color-bodies including low levels of natural organic matter. Technical clay soils used for this work were obtained from commercial companies that supply stained fabrics to the industry (e.g. Empirical Manufacturing Company).

As used herein "plant-derived polyphenolic compound soil" means polyphenolic compounds such as tannins, anthocyanins, chlorophyll and other materials found in colored soils (e.g. wine, grape juice, tea and grass).

The present invention relates to a composition, preferably a cleaning composition comprising an anionically modified catechol and a soil-suspending polymer. It has been found that the combination of anionically modified catechol and soil suspending polymer provides improved clay soil removal. Without being bound by a theory, it is believed that the catechol structure has the ability to strongly bind with $Al^{3+}$ at the edge of clay soil platelets. Anionic groups, such as sulfonate groups, covalently bound to modified catechols, alter the charge on the edge of clay soil platelet, causing the original clay soil platelet edge and face interaction to dissociate and fall apart. These smaller clay soil particles can then be better suspended by a soil-suspending polymer.

The present compositions can be in any conventional form, namely, in the form of a liquid, powder, granules, agglomerate, paste, tablet, pouches, bar, gel, types delivered in dual-compartment containers, spray or foam detergents, premoistened wipes (i.e.; the cleaning composition in combination with a nonwoven material such as that discussed in U.S. Pat. No. 6,121,165, Mackey, et al.), dry wipes (i.e., the cleaning composition in combination with a nonwoven materials, such as that discussed in U.S. Pat. No. 5,980,931, Fowler, et al.) activated with water by a consumer, and other homogeneous or multiphase consumer cleaning product forms.

The composition may also be utilized in laundry cleaning compositions, dishwashing cleaning compositions, car care compositions, for cleaning various surfaces such as hard wood, tile, ceramic, plastic, leather, metal, glass. This cleaning composition could be also designed to be used in a personal care composition such as shampoo composition, body wash, liquid or solid soap and other cleaning composition

Anionically Modified Catechol

The present composition comprises an anionically modified catechol. An anionically modified catechol, as used herein, means 1,2-benzenediol having one or two anionic substitutions on the benzene ring. The anionic substitutions may be selected from sulfonate, sulfate, carbonate, phosphonate, phosphate, fluoride, and mixtures thereof. One embodiment of an anionically modified catechol having two sulfate moieties having a sodium cation on the benzene ring is shown in formula (I).

Formula (I)

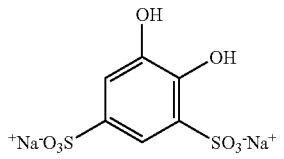

The 1,2-Dihydroxybenzene-3,5-Di-(Sodium Sulfonate) shown may be prepared according to U.S. Pat. No. 3,771,379 example 1. 1,2-benzenediol ("Catechol") is disulfonated with concentrated sulfuric acid/oleum followed by subsequent neutralization with 50% sodium hydroxide and isolation of product.

The anionically modified catechol is present in the composition from about 0.01% to about 10% by weight of the composition. In some embodiments the anionically modified catechol is present from about 0.1% to about 6% by weight of the composition.

In one embodiment, the anionically modified catechol is essentially free of catechol (1,2-benzenediol). Without being bound by a theory, it is believed that catechol may produce a skin irritation when present. As used herein, "essentially free" means less than about 3 wt %, less than about 2 wt %, less than about 1 wt % to 0 wt %, by weight of the anionically modified catechol of catechol being present.

Soil Suspending Polymers

The composition may comprise from about 0.01% to about 10%, preferably from about 0.01% to about 4%, more preferably from about 0.1% to about 6%, most preferably from about 0.2% to about 4% by weight of the composition of a soil suspending polymer selected from polyesters, polycarboxylates, saccharide-based materials, modified polyethyleneimines, modified hexamethylenediamine, branched polyaminoamines, modified polyaminoamide, hydrophobic polyamine ethoxylate polymers, polyamino acids, polyvinylpyridine N-oxide, N-vinylimidazole N-vinylpyrrolidone copolymers, polyvinylpyrrolidone, polyvinyloxazolidone, polyvinylimidazole and mixtures thereof. Suitable polymers may also, generally, have a water solubility of greater than 0.3% at normal usage temperatures.

Polyesters

Polyesters of terephthalic and other aromatic dicarboxylic acids such as polyethylene terephthalate/polyoxyethylene terephthalate and polyethylene terephthalate/polyethylene glycol polymers, among other polyester polymers, may be utilized as the soil suspending polymer in the present composition.

High molecular weight (e.g., 40,000 to 50,000 M.W.) polyesters containing random or block ethylene terephthalate/polyethylene glycol (PEG) terephthalate units have been used as soil release compounds in laundry cleaning compositions. See U.S. Pat. No. 3,962,152, U.S. Pat. No. 3,959,230, U.S. Pat. No. 3,959,230 and U.S. Pat. No. 3,893,929. Sulfonated linear terephthalate ester oligomers are discussed in U.S. Pat. No. 4,968,451. Nonionic end-capped 1,2-propylene/polyoxyethylene terephthalate polyesters are discussed in U.S. Pat. No. 4,711,730 and nonionic-capped block polyester oligomeric compounds are discussed U.S. Pat. No. 4,702,857. Partly- and fully-anionic-end-capped oligomeric esters are discussed further in U.S. Pat. No. 4,721,580 and anionic, especially sulfoaroyl, end-capped terephthalate esters are discussed in U.S. Pat. No. 4,877,896 and U.S. Pat. No. 5,415,807.

U.S. Pat. No. 4,427,557, discloses low molecular weight copolyesters (M.W. 2,000 to 10,000) which can be used in aqueous dispersions to impart soil release properties to polyester fibers. The copolyesters are formed by the reaction of ethylene glycol, a PEG having an average molecular weight of 200 to 1000, an aromatic dicarboxylic acid (e.g. dimethyl terephthalate), and a sulfonated aromatic dicarboxylic acid (e.g. dimethyl 5-sulfoisophthalate). The PEG can be replaced in part with monoalkylethers of PEG such as the methyl, ethyl and butyl ethers.

Polyesters formed from: (1) ethylene glycol, 1,2-propylene glycol or a mixture thereof; (2) a polyethylene glycol (PEG) capped at one end with a C1-$C_4$ alkyl group; (3) a dicarboxylic acid (or its diester); and optionally (4) an alkali metal salt of a sulfonated aromatic dicarboxylic acid (or its diester), or if branched polyesters are desired, a polycarboxylic acid (or its ester). The block polyester polymers are further discussed in U.S. Pat. No. 4,702,857. Poly(vinyl ester) hydrophobe segments, including graft copolymers of poly(vinyl ester), e.g., $C_1$-$C_6$ vinyl esters, preferably poly(vinyl acetate), grafted onto polyalkylene oxide backbones, commercially available under the tradenames of SOKALAN®, such as SOKALAN® HP-22, available from BASF, Germany may also be utilized.

U.S. Pat. No. 4,201,824, discloses hydrophilic polyurethanes having soil release and antistatic properties useful in cleaning compositions. These polyurethanes are formed from the reaction product of a base polyester with an isocyanate prepolymer (reaction product of diisocyanate and macrodiol).

EP 0752468 B1 discloses a water-soluble copolymer providing soil release properties when incorporated in a laundry cleaning composition, the copolymer comprising monomer units of poly(ethylene glycol) and/or capped poly(ethylene glycol) and monomer units of one or more aromatic dicarboxylic acids, characterized in that the copolymer comprises monomer units of poly(ethylene glycol) and/or capped poly (ethylene glycol); monomer units of one or more aromatic dicarboxylic acids wherein the aromatic is optionally sulphonated; and monomer units derived from a polyol having at least 3 hydroxyl groups.

Polycarboxylates

The present composition may comprise a polycarboxylate polymer or co-polymer comprising a carboxylic acid monomer. A water soluble carboxylic acid polymer can be prepared by polyimerizing a carboxylic acid monomer or copolymerizing two monomers, such as an unsaturated hydrophilic monomer and a hydrophilic oxyalkylated monomer. Examples of unsaturated hydrophilic monomers include acrylic acid, maleic acid, maleic anhydride, methacrylic acid, methacrylate esters and substituted methacrylate esters, vinyl acetate, vinyl alcohol, methylvinyl ether, crotonic acid, itaconic acid, vinyl acetic acid, and vinylsulphonate. The hydrophilic monomer may further be copolymerized with oxyalkylated monomers such as ethylene or propylene oxide. Preparation of oxyalkylated monomers is disclosed in U.S. Pat. No. 5,162,475 and U.S. Pat. No. 4,622,378. The hydrophilic oxyalkyated monomer preferably has a solubility of about 500 grams/liter, more preferably about 700 grams/liter in water. The unsaturated hydrophilic monomer may further be grafted with hydrophobic materials such as poly(alkene glycol) blocks. See, for example, materials discussed in U.S. Pat. No. 5,536,440, U.S. Pat. No. 5,147,576, U.S. Pat. No. 5,073,285, U.S. Pat. No. 5,534,183, and WO 03/054044.

Other polymeric polycarboxylates that are suitable include, for example, the polymers disclosed in U.S. Pat. No. 5,574,004. Such polymers include homopolymers and/or copolymers (composed of two or more monomers) of an alpha, beta-ethylenically unsaturated acid monomer such as acrylic acid, methacrylic acid, a diacid such as maleic acid, itaconic acid, fumaric acid, mesoconic acid, citraconic acid and the like, and a monoester of a diacid with an alkanol, e.g., having 1-8 carbon atoms, and mixtures thereof.

When the polymeric polycarboxylate is a copolymer, it can be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which can be either relatively non-polar such as styrene or an olefmic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide.

Copolymers of at least one unsaturated carboxylic acid monomer with at least one non-carboxylic comonomer should contain at least about 50 mol % of polymerized carboxylic acid monomer. The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions.

Saccharide Based Materials

The present composition may comprise a soil suspension polymer derived from saccharide based materials. Saccharide based materials may be natural or synthetic and include derivatives and modified saccharides. Suitable saccharide based materials include cellulose, gums, arabinans, galactans, seeds and mixtures thereof.

Saccharide derivatives may include saccharides modified with amines, amides, amino acids, esters, ethers, urethanes, alcohols, carboxylic acids, silicones, sulphonates, sulphates, nitrates, phosphates and mixtures thereof.

Modified celluloses and cellulose derivatives, such as carboxymethylcellulose, hydroxyethylcellulose, methyl cellulose, ethyl cellulose, cellulose sulphate, cellulose acetate (see U.S. Pat. No. 4,235,735), sulphoethyl cellulose, cyanoethyl cellulose, ethyl hydroxyethylcellulose, hydroxyethyl cellulose and hydroxypropylcellulose are suitable for use in the composition. Some modified celluloses are discussed in GB 1 534 641, U.S. Pat. No. 6,579,840 B1, WO 03/040279 and WO 03/01268.

Another example of a soil suspending polymer suitable for use in the present invention includes saccharide derivatives that are polyol compounds comprising at least three hydroxy moieties, preferably more than three hydroxy moieties, most preferably six or more hydroxy moieties. At least one of the hydroxy moieties further comprising a alkoxy moiety, the alkoxy moiety is selected from the group consisting of ethoxy (EO), propoxy (PO), butoxy (BO) and mixtures thereof preferably ethoxy and propoxy moieties, more preferably ethoxy moieties. The average degree of alkoxylation is from about 1 to about 100, preferably from about 4 to about 60, more preferably from about 10 to about 40. Alkoxylation is preferably block alkoxylation.

The polyol compounds useful in the present invention further have at least one of the alkoxy moieties comprising at least one anionic capping unit. Further modifications of the compound may occur, but one anionic capping unit must be present in the compound of the present invention. One embodiment comprises more than one hydroxy moiety further comprising an alkoxy moiety having an anionic capping unit. For example

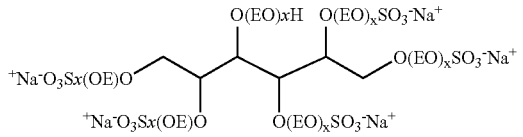

such as the shown in the formula:

wherein x of the anionic capped polyol compound is from about 1 to about 100, preferably from about 10 to about 40. EO represents an ethoxy moiety (—$CH_2CH_2$—). A sodium counterion is shown, but the embodiment is not limited to sodium counterions.

Suitable anionic capping unit include sulfate, sulfosuccinate, succinate, maleate, phosphate, phthalate, sulfocarboxylate, sulfodicarboxylate, propanesultone, 1,2-disulfopropanol, sulfopropylamine, sulphonate, monocarboxylate, methylene carboxylate, ethylene carboxylate, carbonates, mellitic, pyromellitic, sulfophenol, sulfocatechol, disulfocatechol, tartrate, citrate, acrylate, methacrylate, poly acrylate, poly acrylate-maleate copolymer, and mixtures thereof. Preferably the anionic capping units are sulfate, sulfosuccinate, succinate, maleate, sulfonate, methylene carboxylate and ethylene carboxylate.

Suitable polyol compounds for starting materials for use in the present invention include maltitol, sucrose, xylitol, glycerol, pentaerythitol, glucose, maltose, matotriose, maltodextrin, maltopentose, maltohexose, isomaltulose, sorbitol, poly vinyl alcohol, partially hydrolyzed polyvinylacetate, xylan reduced maltotriose, reduced maltodextrins, polyethylene glycol, polypropylene glycol, polyglycerol, diglycerol ether and mixtures thereof. Preferably the polyol compound is sorbitol, maltitol, sucrose, xylan, polyethylene glycol, polypropylene glycol and mixtures thereof. Preferably the starting materials are selected from sorbitol, maltitol, sucrose, xylan, and mixtures thereof.

Modification of the polyol compounds is dependant upon the desired formulability and performance requirements. Modification can include incorporating anionic, cationic, or zwitterionic charges to the polyol compounds. In one embodiment, at least one hydroxy moiety comprises an alkoxy moiety, wherein at least one alkoxy moiety further comprises at least one anionic capping unit. In another embodiment, at least one hydroxy moiety comprises an alkoxy moiety, wherein the alkoxy moiety further comprises more than one anionic capping unit, wherein at least one anionic capping unit, but less than all anionic capping units, is then selectively substituted by an amine capping unit. The amine capping unit is selected from a primary amine containing capping unit, a secondary amine containing capping unit, a tertiary amine containing capping unit, and mixtures thereof.

The polyol compounds useful in the present invention further have at least one of the alkoxy moieties comprising at least one amine capping unit. Further modifications of the compound may occur, but one amine capping unit must be present in the compound of the present invention. One embodiment comprises more than one hydroxy moiety further comprising an alkoxy moiety having an amine capping unit. In another embodiment, at least one of nitrogens in the amine capping unit is quatemized. As used herein "quaternized" means that the amine capping unit is given a positive charge through quatemization or protonization of the amine capping unit. For example, bis-DMAPA contains three nitrogens, only one of the nitrogens need be quatemized. However, it is preferred to have all nitrogens quaternized on any given amine capping unit.

Suitable primary amines for the primary amine containing capping unit include monoamines, diamine, triamine, polyamines, and mixtures thereof. Suitable secondary amines for the secondary amine containing capping unit include monoamines, diamine, triamine, polyamines, and mixtures thereof. Suitable tertiary amines for the tertiary amine containing capping unit include monoamines, diamine, triamine, polyamines, and mixtures thereof.

Suitable monoamines, diamines, triamines or polyamines for use in the present invention include ammonia, methyl amine, dimethylamine, ethylene diamine, dimethylaminopropylamine, bis dimethylaminopropylamine (bis DMAPA), hexemethylene diamine, benzylamine, isoquinoline, ethylamine, diethylamine, dodecylamine, tallow triethylenediamine, mono substituted monoamine, monosubstituted diamine, monosubstituted polyamine, disubstituted monoamine, disubstiuted diamine, disubstituted polyamine, trisubstituted triamine, tri substituted polyamine, multisubstituted polyamine comprising more than three substitutions provided at least one nitrogen contains a hydrogen, and mixtures thereof.

In another embodiment, at least one of nitrogens in the amine capping unit is quatemized. As used herein "quaternized" means that the amine capping unit is given a positive charge through quaternization or protonization of the amine capping unit. For example, bis-DMAPA contains three nitrogens, only one of the nitrogens need be quaternized. However, it is preferred to have all nitrogens quatemized on any given amine capping unit.

Modified Polyethyleneimine Polymer

The present composition may comprise a modified polyethyleneimine polymer. The modified polyethyleneimine polymer has a polyethyleneimine backbone having a molecular weight from about 300 to about 10000 weight average molecular weight, preferably from about 400 to about 7500 weight average molecular weight, preferably about 500 to about 1900 weight average molecular weight and preferably from about 3000 to 6000 weight average molecular weight.

The modification of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on by a polyalkoxylene chain having an average of about 1 to about 40 alkoxy moieties per modification, wherein the terminal alkoxy moiety of the alkoxylation modification is capped with hydrogen, a $C_1$-$C_4$ alkyl, sulfates, carbonates, or mixtures thereof; (2) a substitution of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety and $X^-$ represents a suitable water soluble counterion.

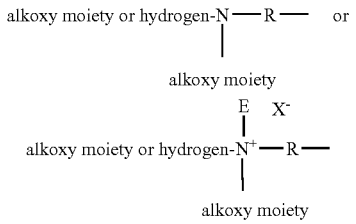

Also, for example, but not limited to, below is shown possible modifications to internal nitrogen atoms in the polyethyleneimine backbone where R represents an ethylene spacer and E represents a $C_1$-$C_4$ alkyl moiety and X— represents a suitable water soluble counterion.

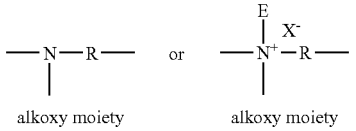

The alkoxylation modification of the polyethyleneimine backbone consists of the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties. More preferably, the polyalkoxylene chain is ethoxy moieties in an average degree of from about 5 to about 15 and the polyalkoxylene chain is ethoxy/propoxy block moieties having an average degree of ethoxylation from about 5 to about 15 and an average degree of propoxylation from about 1 to about 16. Most preferable the polyalkoxylene chain is the ethoxy/propoxy block moieties wherein the propoxy moiety block is the terminal alkoxy moiety block.

The modification may result in permanent quatemization of the polyethyleneimine backbone nitrogen atoms. The degree of permanent quatemization may be from 0% to about 30% of the polyethyleneimine backbone nitrogen atoms. It is preferred to have less than 30% of the polyethyleneimine backbone nitrogen atoms permanently quatemized. Modified polyethyleneimine polymers are also described in U.S. Pat. No. 5,565,145.

Modified Hexamethylenediamine

The present composition may comprise a modified hexamentylenediamine. The modification of the hexamentylenediamine includes: (1) one or two alkoxylation modifications per nitrogen atom of the hexamentylenediamine. The alkoxylation modification consisting of the replacement of a hydrogen atom on the nitrogen of the hexamentylenediameine by a (poly)alkoxylene chain having an average of about 1 to about 40 alkoxy moieties per modification, wherein the terminal alkoxy moiety of the alkoxylene chain is capped with hydrogen, a $C_1$-$C_4$ alkyl, sulfates, carbonates, or mixtures thereof; (2) a substitution of one $C_1$-$C_4$ alkyl moiety and one or two alkoxylation modifications per nitrogen atom of the hexamentylenediamine. The alkoxylation modification consisting of the replacement of a hydrogen atom by a (poly)alkoxylene chain having an average of about 1 to about 40 alkoxy moieties per modification wherein the terminal alkoxy moiety of the alkoxylene chain is capped with hydrogen, a $C_1$-$C_4$ alkyl or mixtures thereof; or (3) a combination thereof. The alkoxylation may be in the form of ethoxy, propoxy, butoxy or a mixture thereof. U.S. Pat. No. 4,597,898 Vander Meer, issued Jul. 1, 1986, A preferred modified hexamethylenediamine has the general structure below:

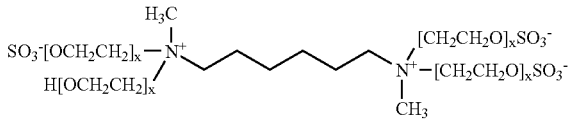

wherein x is from about 20 to about 30 and approximately 40% of the (poly)alkoxylene chain terminal alkoxy moieties are sulfonated.

A preferred modified hexamethylenediamine has the general structure below:

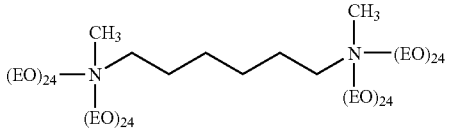

where x of the polyaminoamine can be from 1 to 12, more preferably from 1 to 8, more preferably from 1 to 6 and even more preferably from 1 to 4, $R_5$ and $R_6$ of the polyaminoamine may not be present (at which case N is neutral), and/or may be independently chosen from group of H, aliphatic $C_1$-$C_6$, alkylene $C_2$-$C_6$, arylene, or alkylarylene, $R_1$, $R_2$, $R_3$, and R4 of the polyaminoamine are independently chosen from the group of H, OH, aliphatic $C_1$-$C_6$, alkylene $C_2$-$C_6$, arylene, or alkylarylene, preferably at least one or more block of polyoxyalkylene $C_2$-$C_5$, and single and/or repeating block units of linear or branched alkylene ($C_1$-$C_{20}$), linear or branched oxyalkylene ($C_2$-$C_5$) and mixtures of thereof. $A_1$, $A_2$, $A_3$, $A_4$, $A_5$, and $A_6$ of the polyaminoamine are capping groups independently selected from hydrogen, hydroxy, sulfate, sulfonate, carboxylate, phosphate, and mixtures thereof. If $R_1$, $R_2$, $R_3$, or $R_4$ are $N(CH_2)_xCH_2$, than it represent continuation of this structure by branching. See also U.S. Pat. No. 4,597,898; U.S. Pat. No. 4,891,160; U.S. Pat. No. 5,565,145; and U.S. Pat. No. 6,075,000. The average degree of alkoxylation can also be more than 7, preferably from about 7 to about 40.

Modified Polyaminoamide

Modified polyaminoamides, such as the ones discussed in U.S. Pat. No. 2005/0209125 A1, may be utilized as a soil suspending polymer. Suitable modified polyaminoamides have, depending on their degree of alkoxylation, a number average molecular weight ($M_n$) of from 1,000 to 1,000,000, preferably from 2,000 to 1,000,000 and more preferably from 2,000 to 50,000.

One embodiment of a modified polyaminoamide has the formula:

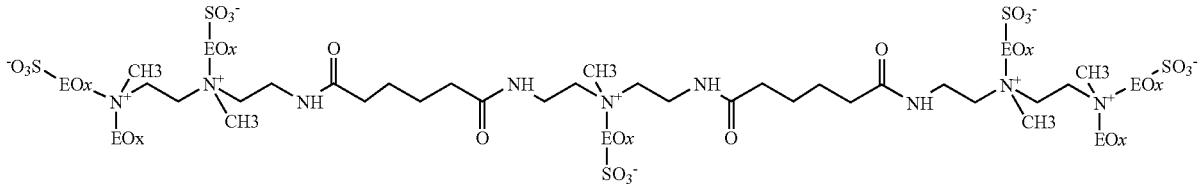

available under the tradename LUTENSIT® from BASF and such as those described in WO 01/05874.

Branched Polyaminoamines

An embodiment of a soil suspending polymer is exemplified in structural formula below:

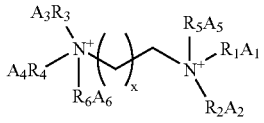

wherein x of the polyaminoamide is from 10 to 200, preferably from about 15 to about 150, most preferably from about 21 to about 100. Most preferably the number average of x of the polyaminoamide ranges from 15 to 70, especially 21 to 50. EO in the polyaminoamide represents ethoxy moieties.

In another preferred embodiment, the detergent composition comprises a modified polyaminoamide wherein the ratio of dicarboxylic acid:polyalkylenepolyamines is 4:5 and 35:36; the polyalkylenepolyamine is quatemized as described in formula (a), (b1) and (b2) above.

Hydrophobic Polyamine Ethoxylate Polymers

Soil suspending polymer for the composition may include hydrophobic polyamine ethoxylate polymers characterized by comprising a general formula:

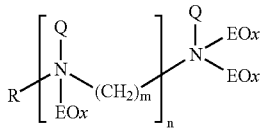

R of the hydrophobic polyamine ethoxylate polymer is a linear or branched $C_1$-$C_{22}$ alkyl, a linear or branched $C_1$-$C_{22}$ alkoxyl, linear or branched $C_1$-$C_{22}$ acyl, and mixtures thereof; if R is selected as being branched, the branch may comprise from 1 to 4 carbon atoms; preferably R of the hydrophobic polyamine ethoxylate polymer is a linear $C_{12}$ to $C_{18}$ alkyl. The alkyl, alkoxyl, and acyl may be saturated or unsaturated, preferably saturated. The n index of the hydrophobic polyamine ethoxylate polymer is from about 2 to about 9, preferably from about 2 to about 5, most preferably 3.

Q of the hydrophobic polyamine ethoxylate polymer is independently selected from an electron pair, hydrogen, methyl, ethyl, and mixtures thereof. If the formulator desires a neutral backbone of the hydrophobic polyamine ethoxylate, Q of the hydrophobic polyamine ethoxylate polymer should be selected to be an electron pair or hydrogen. Should the formulator desire a quatemized backbone of the hydrophobic polyamine ethoxylate; at least on Q of the hydrophobic polyamine ethoxylate polymer should be chosen from methyl, ethyl, preferably methyl.

The m index of the hydrophobic polyamine ethoxylate polymer is from 2 to 6, preferably 3. The index x of the hydrophobic polyamine ethoxylate polymer is independently selected to average from about 1 to about 70 ethoxy units, preferably an average from about 20 to about 70, preferably about 30 to about 50, for polymers containing nonquaternized nitrogens; preferably from about 1 to about 10 for polymers containing quaternized nitrogens.

The ethoxy units of the hydrophobic polyamine ethoxylate may be further modified by independently adding an anionic capping unit to any or all ethoxy units. Suitable anionic capping units include sulfate, sulfosuccinate, succinate, maleate, phosphate, phthalate, sulfocarboxylate, sulfodicarboxylate, propanesultone, 1,2-disulfopropanol, sulfopropylamine, sulphonate, monocarboxylate, methylene carboxylate, carbonates, mellitic, pyromellitic, citrate, acrylate, methacrylate, and mixtures thereof. Preferably the anionic capping unit is a sulfate.

In another embodiment, the nitrogens of the hydrophobic polyamine ethoxylate polymer are given a positive charge through quaternization. As used herein "quaternization" means quaternization or protonization of the nitrogen to give a positive charge to the nitrogens of the hydrophobic polyamine ethoxylate.

Polyamino Acids

The soil suspending polymers can be derived from L-glumatic acid, D-glumatic acid or mixtures, e.g. racemates, of these L and D isomers. The polymers include not only the homopolymers of glutamic acid but also copolymers, such as block, graft or random copolymers, containing glutamic acid. These include, for example, copolymers containing at least one other amino acid, such as aspartic acid, ethylene glycol, ethylene oxide, (or an oligimer or polymer of any of these) or polyvinyl alcohol. Glutamic acid can, of course, carry one or more substituents including, for example, alkyl, hydroxy alkyl, aryl and arylalkyl, commonly with up to 18 carbon atoms per group, or polyethylene glycol attached by ester linkages. See U.S. Pat. No. 5,470,510 A, issued Nov. 28, 1995.

Polyamine N-oxide Polymers

The polyamine N-oxide polymers suitable for use herein contain a polymerisable unit, whereto an N-oxide group can be attached to or wherein the N-oxide group forms part of the polymerisable unit or a combination of both. Suitable polyamine N-oxides wherein the N-oxide group forms part of the polymerisable unit comprise polyamine N-oxides wherein the N-oxide group comprises part of a heterocyclic group such as pyridine, pyrrole, imidazole, pyrrolidine, piperidine, quinoline, acridine and derivatives thereof. Another class of said polyamine N-oxides comprises the group of polyamine N-oxides wherein the N-Oxide group is attached to the polymerisable unit. Preferred class of these polyamine N-oxides are the polyamine N-oxides.

Any polymer backbone can be used as long as the amine oxide polymer formed has dye transfer inhibiting properties. Examples of suitable polymeric backbones are polyvinyls, polyalkylenes, polyesters, polyethers, polyamide, polyimides, polyacrylates and mixtures thereof. The amine N-oxide polymers of the present invention typically have a ratio of amine to the amine N-oxide of about 10:1 to about 1:1000000. However the amount of amine oxide groups present in the polyamine oxide polymer can be varied by appropriate copolymerization or by appropriate degree of N-oxidation. Preferably, the ratio of amine to amine N-oxide is from about 2:3 to about 1:1000000; from about 1:4 to about 1:1000000; and from about 1:7 to about 1:1000000. The soil suspending polymers encompass random or block copolymers where one monomer type is an amine N-oxide and the other monomer type is either an amine N-oxide or not. The amine oxide unit of the polyamine N-oxides has a pKa<10, pKa<7, and pKa<6. The polyamine oxides can be obtained in almost any degree of polymerization. The degree of polymerization is not critical provided the material has the desired soil-suspending power. Typically, the average molecular weight is within the range of about 500 to about 1000,000; from about 1,000 to about 50,000, from about 2,000 to about 30,000, and from about 3,000 to about 20,000.

N-Vinylimidazole N-Vinylpyrrolidone Copolymers

Suitable soil suspending polymers for use in the cleaning compositions are selected from N-vinylimidazole N-vinylpyrrolidone copolymers wherein a molar ratio of N-vinylimidazole to N-vinylpyrrolidone from about 1 to about 0.2, from about 0.8 to about 0.3, and from about 0.6 to about 0.4 and said polymer has an average molecular weight range from about 5,000 to about 50,000; from about 8,000 to about 30,000; and from about 10,000 to about 20,000. The average molecular weight range was determined by light scattering as described in Barth H. G. and Mays J. W. Chemical Analysis Vol 113,"Modem Methods of Polymer Characterization".

Polyvinylpyrrolidone

Another suitable soil suspending polymer for use herein comprise a polymer selected from polyvinylpyrrolidone ("PVP") having an average molecular weight from about 2,500 to about 400,000 can also be utilized; from about 5,000 to about 200,000; from about 5,000 to about 50,000; and from about 5,000 to about 15,000 can also be utilized. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan® HP 165 and Sokalan® HP 12; polyvinylpyrrolidones known to persons skilled in the detergent field (see for example EP-A-262,897 and EP-A-256,696).

Polyvinyloxazolidone and Polyvinylimidazole

Other suitable soil suspending polymers for use herein include polyvinyloxazolidone having an average molecular weight from about 2,500 to about 400,000 and polyvinylimidazole having an average molecular weight from about 2,500 to about 400,000.

Surfactants

The cleaning compositions of the present invention may further optionally comprise from about 0.1% to about 20%, preferably from about 0.2% to about 10%, more preferably from about 0.2% to about 5% by weight of the cleaning composition of a surfactant system having one or more surfactants.

Surfactant system that may be used for the present invention may comprise one or more surfactants selected from nonionic, anionic, cationic surfactants, ampholytic, zwitterionic, semi-polar nonionic surfactants, other adjuncts such as alkyl alcohols, or mixtures thereof.

Anionic Surfactants

Nonlimiting examples of anionic surfactants useful herein include: $C_8$-$C_8$ alkyl benzene sulfonates (LAS); $C_{10}$-$C_{20}$ primary, branched-chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein preferably x is from 1-30; $C_{10}$-$C_{18}$ alkyl alkoxy carboxylates preferably comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303; modified alkylbenzene sulfonate (MLAS) as discussed in WO 99/05243, WO 99/05242, and WO 99/05244; methyl ester sulfonate (MES); and alpha-olefin sulfonate (AOS).

Nonionic Co-Surfactants

Non-limiting examples of nonionic co-surfactants include: $C_{12}$-$C_{18}$ alkyl ethoxylates, such as, NEODOL® nonionic surfactants from Shell and LUTENSOL® XL and LUTENSOL® XP from BASF; $C_6$-$C_{12}$ alkyl phenol alkoxylates wherein the alkoxylate units are a mixture of ethoxy and propoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, BAEX, wherein x is from 1-30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. No. 4,681,704, and U.S. Pat. No. 4,133,779.

Builders

The cleaning compositions of the present invention optionally comprise one or more detergent builders or builder systems. When present, the compositions will typically comprise at least about 1% to about 80% by weight, from about 5% to about 50% by weight, from about 10% to about 40% by weight, of detergent builder.

Builders include, but are not limited to, the alkali metal, ammonium and alkanolammonium salts of polyphosphates, alkali metal silicates, alkaline earth and alkali metal carbonates, aluminosilicate builders polycarboxylate compounds. ether hydroxypolycarboxylates, copoly-mers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The cleaning compositions herein may also optionally contain an organic detergent builder material. Examples include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, $C_{10}$-$C_{22}$ fatty acids and citric acid. Other examples are DEQUEST® organic phosphonate type sequestering agents sold by Monsanto and alkanehydroxy phosphonates. Citrate salts and $C_{12}$-$C_{18}$ fatty acid soaps are highly preferred.

Other organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the SOKALAN® trademark, copolymers of polyacrylic acid with either ionic and/or hydrophobic materials. It is important to note that one has to employ care in the choice of such polymeric materials to formulate into liquid cleaning composition with desired % T. This may be achieved by appropriate molecular optimization of such materials, optimization and definition of Formulation Tolerance required for these materials to form clear and transparent formulations, and/or addition of such materials at appropriate level to formulate into clear and transparent liquid cleaning composition. If utilized, the composition may comprise up to 30%, from 0% to about 20%, from about 0.01% to about 10%, by weight of the composition, of the organic builder materials.

Dependent upon use of the cleaning composition, phosphated builders such as STPP may also be utilized. If utilized, the composition may comprise up to about 50%, from 0% to about 30%, from about 0.01% to about 25%, by weight of the composition of phosphated builder.

Optional Components

The cleaning compositions of the present invention can also include any number of additional optional ingredients.

These include conventional laundry cleaning composition components such as a liquid carrier, detersive builders, enzymes, enzyme stabilizers (such as propylene glycol, boric acid and/or borax), chelating agents, suds suppressors, other fabric care benefit agents, pH adjusting agents, smectite clays, structuring agents, dye transfer inhibiting agents, optical brighteners, perfumes and coloring agents. These also include conventional dish cleaning composition components such as liquid carrier, zinc containing compounds for glass care, phosphated builders, suds suppressors, enzymes, enzyme stabilizers (such as boric acid and/or borax), chelating agents, structuring agents, perfumes and coloring agents. The various optional cleaning composition ingredients, if present in the compositions herein, should be utilized at concentrations conventionally employed to bring about their desired contribution to the cleaning composition or the laundering operation. Frequently, the total amount of such optional cleaning composition ingredients can range from about 5% to about 50%, more preferably from about 5% to about 40%, by weight of the composition.

Liquid Carrier

The liquid cleaning compositions according to the present invention also contain a liquid carrier. Typically the amount of the liquid carrier employed in the compositions herein will be relatively large, often comprising the balance of the cleaning composition, but can comprise from about 5 wt % to about 85 wt % by weight of the cleaning composition. In one embodiment low levels, 5% to 20% by weight of the cleaning composition of liquid carrier is utilized.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such $C_1$-$C_3$ lower alkanols such as methanol, ethanol and/or propanol, diols, other polyols, ethers, $C_1$-$C_3$ alkanolamines such as mono-, di- and triethanolamines, and the like, have been conventionally been added to liquid cleaning compositions as hydrotropes, co-solvents or stabilizers. Thickeners, if desired, may also be utilized, such as Polygel DKP®, a polyacrylate thickener from ex 3V Co. If utilized, phase stabilizers/co-solvents can comprise from about 0.1% to 5.0% by weight of the compositions herein.

Enzymes

Enzymes can be included in effective amounts in the liquid laundry cleaning composition herein for a wide variety of fabric laundering purposes, including removal of protein-based, carbohydrate-based, or triglyceride-based stains, for example, and/or for fabric restoration. As used herein, an "effective amount" is an amount of additional enzyme to achieve the desired removal of a stain or amount of fabric restoration.

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, 13-glucanases, arabinosidases, hyaluronidase, chondroitinase, laccase, and known amylases, or combinations thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on.

A potential enzyme combination comprises a cocktail of conventional detersive enzymes like protease, lipase, cutinase and/or cellulase in conjunction with amylase. Detersive enzymes are described in greater detail in U.S. Pat. No. 6,579,839. Particularly preferred compositions herein contain from about 0.05% to about 2% by weight of detersive enzymes.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01% to 1% by weight of a commercial enzyme preparation. Protease enzymes are usually present in such commercial preparations at levels sufficient to provide from 0.005 to 0.1 Anson units (AU) of activity per gram of composition.

Enzyme materials useful for liquid detergent formulations, and their incorporation into such formulations, are disclosed in U.S. Pat. No. 4,261,868, Hora et al, and in U.S. Pat. No. 4,507,219, Hughes.

Enzyme Stabilizer

If an enzyme or enzymes are included in the compositions of the present invention, it is preferred that the composition also contain an enzyme stabilizer. Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds (i.e., certain esters, diakyl glycol ethers, alcohols or alcohol alkoxylates), alkyl ether carboxylate in addition to a calcium ion source, benzamidine hypochlorite, lower aliphatic alcohols and carboxylic acids, N,N-bis(carboxymethyl)serine salts; (meth)acrylic acid-(meth)acrylic acid ester copolymer and PEG; lignin compounds, polyamide oligomer, glycolic acid or its salts; poly hexa methylene bi guanide or N,N-bis-3-amino-propyl-dodecyl amine or salt; and mixtures thereof. See also U.S. Pat. No. 3,600,319, Gedge, et al., EP 0 199 405 A, Venegas, U.S. Pat. No. 3,519,570 and U.S. Pat. No. 4,537,706 (borate species).

Typical detergents, especially liquids, will comprise from about 1 to about 30, preferably from about 2 to about 20, more preferably from about 5 to about 15, and most preferably from about 8 to about 12, millimoles of calcium ion per liter of finished composition to provide enzyme stability. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. Accordingly, as a general proposition the compositions herein will typically comprise from about 0.05% to about 2% by weight of the cleaning composition of a water-soluble source of calcium or magnesium ions, or both.

In a liquid composition, the degradation by the proteolytic enzyme of second enzymes can be avoided by protease reversible inhibitors such as peptide or protein type, in particular the modified subtilisin inhibitor of family VI and the plasminostrepin; leupeptin, peptide trifluoromethyl ketones, peptide aldehydes.

Chelating Agents

Chelating agents useful herein are selected from all compounds in any suitable amount or form that control the adverse effects of heavy metal contamination or water hardness (for example, calcium and magnesium ions) in an aqueous bath by binding with metal ions. Any ligand with multidentate is suitable as a chelating agent. For example, suitable chelating agents can include, but are not limited to, carboxylates, phosphates, phosphonates, polyfunctionally-substituted aromatic compounds, polyamines, biodegradable compounds, the alkali metal, ammonium or substituted ammonium salts or complexes of these chelating agents, and mixtures thereof. Further examples of suitable chelating agents and levels of use are described in U.S. Pat. Nos. 3,812,044; 4,704,233; 5,292,446; 5,445,747; 5,531,915; 5,545,352; 5,576,282; 5,641,739; 5,703,031; 5,705,464; 5,710,115; 5,710,115; 5,712,242; 5,721,205; 5,728,671; 5,747,440; 5,780,419; 5,879,409; 5,929,010; 5,929,018; 5,958,866; 5,965,514; 5,972,038; 6,172,021; and 6,503,876.

The chelating agents, when present, may comprise from 0.1% to about 5%, 0.25% to 3% by weight of the composition.

Methods

The present invention includes a method for cleaning a surface or fabric. Such method includes the steps of contacting composition of the present invention, in neat form or diluted in a wash liquor, with at least a portion of a surface or fabric then optionally rinsing such surface or fabric. Preferably the surface or fabric is subjected to a washing step prior to the aforementioned optional rinsing step. For purposes of the present invention, washing includes but is not limited to, scrubbing, and mechanical agitation.

As will be appreciated by one skilled in the art, the cleaning compositions of the present invention are ideally suited for use in home care (hard surface cleaning compositions), personal care and/or laundry applications. Accordingly, the present invention includes a method for cleaning a surface and/or laundering a fabric. The method comprises the steps of contacting a surface and/or fabric to be cleaned/laundered with the composition of the present invention. The surface may comprise most any hard surface being found in a typical home such as hard wood, tile, ceramic, plastic, leather, metal, glass, or may consist of a cleaning surface in a personal care product such as hair and skin. The surface may also include dishes, glasses, and other cooking surfaces. The fabric may comprise most any fabric capable of being laundered in normal consumer use conditions.

The cleaning composition solution pH is chosen to be the most complimentary to a surface to be cleaned spanning broad range of pH, from about 5 to about 11. For personal care such as skin and hair cleaning pH of such composition preferably has a pH from about 5 to about 8 for laundry cleaning compositions pH of from about 8 to about 10. The compositions are preferably employed at concentrations of from about 200 ppm to about 10,000 ppm in solution. The water temperatures preferably range from about 5° C. to about 100° C.

For use in laundry cleaning compositions, the compositions are preferably employed at concentrations from about 200 ppm to about 10000 ppm in solution (or wash liquor). The water temperatures preferably range from about 5° C. to about 60° C. The water to fabric ratio is preferably from about 1:1 to about 20:1.

The composition described herein can be used for the cleaning of soiled dishes by contacting the composition with a dish surface and then rinsing the dish surface with water. Optionally the dishes are allowed to dry either by heat or by air drying. Preferably the dishes are placed into an automatic dishwashing unit. The automatic dishwashing composition suitable herein can be dispensed from any suitable device, including but not limited to: dispensing baskets or cups, bottles (pump assisted bottles, squeeze bottles, etc.), mechanic pumps, multi-compartment bottles, capsules, multi-compartment capsules, paste dispensers, and single- and multi-compartment water-soluble pouches, and combinations thereof. For example, a multi-phase tablet, a water-soluble or water-dispersible pouch, and combinations thereof, may be used to deliver the composition to the desired dish surface.

As will be appreciated by one skilled in the art, the cleaning compositions of the present invention are also suited for use in personal cleaning care applications. Accordingly, the present invention includes a method for cleaning skin or hair. The method comprises the steps of contacting a skin/hair to be cleaned with a cleaning solution or nonwoven substrate impregnated with an embodiment of Applicants' cleaning composition. The method of use of the nonwoven substrate when contacting skin and hair may be by the hand of a user or by the use of an implement to which the nonwoven substrate attaches.

FORMULATIONS

TABLE 1

| | Granular Laundry Detergents | | | | | |
|---|---|---|---|---|---|---|
| | A (wt %) | B (wt %) | C (wt %) | D (wt %) | E (wt %) | F (wt %) |
| $C_{11-12}$ linear alkyl benzene sulfonate | 0.073 | 0.01 | 7.0 | 19 | 18 | 21 |
| Mid-branched $C_{16-18}$ alkyl sulfate[1] | 10.7 | 10.2 | — | — | — | — |
| $C_{14-15}$ alkyl sulfate | 4.6 | 4.0 | 0.78 | 1 | 1.1 | 0.9 |
| $C_{14-15}$ alkyl ethoxy ($EO_7$) alcohol | — | — | 3.0 | — | — | — |
| $C_{14-15}$ alkyl ethoxy ($EO_3$) alcohol | — | — | — | 0.3 | 0.3 | 0.2 |
| $C_{8-10}$ alkyl dimethy ethoxyl amine | — | — | 0.92 | — | — | — |
| $C_{8-10}-N^{+}(CH_3)_2-(CH_2CH_2)OH$ | | | | | | |
| Zeolite A | 27 | 23 | 15 | 10.5 | 10 | 14 |
| Carbonate | 25 | 33 | 13 | 21 | 19 | 21 |

TABLE 1-continued

| Granular Laundry Detergents | A (wt %) | B (wt %) | C (wt %) | D (wt %) | E (wt %) | F (wt %) |
|---|---|---|---|---|---|---|
| Citric acid | — | — | 2.8 | — | — | — |
| Sodium percarbonate | 3.0 | 5.6 | 13.0 | 4.5 | 4.8 | 0.5 |
| Sodium sulfate | 14 | 10 | 29 | 22 | 24 | 11 |
| Magnesium Sulfate | — | — | 0.7 | — | — | — |
| Anionically Modified Catechol[2] | 0.1-4% | 0.1-4% | 0.1-4% | 0.1-4% | 0.1-4% | 0.1-4% |
| Soil suspending polymer[3]: | 0.1-6% | 0.1-6% | 0.1-6% | 0.1-6% | 0.1-6% | 0.1-6% |
| Carboxy methyl cellulose | — | — | 0.18 | — | — | — |
| S,S-(ethylenediamine N,N'-disuccinic acid) | — | — | 0.20 | — | — | — |
| Polyethylene glycol | 1.2 | 0.7 | — | 0.4 | 0.4 | — |
| Diethylene triamine penta acetate | 0.7 | — | — | — | — | — |
| Bleach[4] | 1.9 | 0.4 | 3.5 | 2.5 | 3.7 | — |
| Enzyme[5] | 0.13 | 0.13 | 0.6 | 0.2 | 0.5 | 0.2 |
| Imidazole-epichlorhydrin | 0.15 | — | — | | | |
| Smectite/montmorillonite clay | — | — | — | — | — | 16 |
| Hydrotrope (SXS) | — | — | — | 1.7 | 1.6 | 0.5 |
| Perfume, dye, brightener, processing aids, other optional components and water | balance | balance | balance | balance | balance | balance |

[1]such as those described in U.S. Pat. No. 6,020,303 and U.S. Pat. No. 6,060,443
[2]such as those described above
[3]such as acrylic acid/maleic acid copolymer, hexamentylene diamine ethoxylate and/or polyacrylate polymer described above.
[4]NOBS and/or TAED.
[5]one or more enzymes such as protease, mannaway, natalase, lipase and mixture thereof.

TABLE II

| Liquid laundry detergents | G (wt %) 100% | H (wt %) 100% |
|---|---|---|
| $C_{12-15}$ alkyl ethoxy ($EO_{1.8}$) sulfate | 11 | 12.65 |
| Sodium formate | 1.6 | 0.09 |
| Sodium hydroxide | 2.3 | 3.8 |
| monoethanolamine | 1.4 | 1.490 |
| Diethylene glycol | 5.5 | 0.0 |
| $C_{12-13}$ ethoxylated ($EO_9$) alcohol | 0.4 | 0.6 |
| diethylene triamine penta acetate MW = 393 | 0.15 | 0.15 |
| $C_{11-12}$ linear alkyl benzene sulfonate | 4 | 6.6 |
| Citric Acid | 0-4% | 0-4% |
| $C_{12-14}$ dimethyl Amine Oxide | 0.3 | 0.73 |
| $C_{12-18}$ Fatty Acid | 0.8 | 1.9 |
| Borax | 1.43 | 1.5 |
| Ethanol | 1.54 | 1.77 |
| Anionically Modified Catechol[1] | 0.1-6% | 0.1-6% |
| Soil suspending polymer[2] | 0.2-12% | 0.2-12% |
| 1,2-Propanediol | 0.0 | 6.6 |
| Enzyme*[3] | 1.0-37.0 | 1.0-37.0 |
| Water, perfume, dyes & other components | Balance to 100% | Balance to 100% |

[1]such as those described above
[2]a water soluble soil suspending polymer such as described in U.S. Pat. No. 4,597,898, U.S. Pat. No. 5,565,145, available under the tradename LUTENSIT ® from BASF and such as those described in WO 01/05874.
[3]one or more enzymes such as protease, mannaway, natalase, lipase and mixture thereof.
*Numbers quoted in mg enzyme/100 g

TABLE III

| Automatic Dishwashing Cleaning composition | Gel (wt %) | Powder (wt %) |
|---|---|---|
| STPP | 0-30 | 0-30 |
| Polygel DKP[1] | 1-2 | — |
| SLF-18 poly-tergent[2] | 0-2 | 0.5-2 |
| Alcosperse 246[3] | — | 0-5 |
| Anionically Modified Catechol[4] | 0.1-6 | 0.1-6 |
| Soil suspending polymer[5] | 0.2-6 | 0.2-6 |
| hydrozincite | 0-0.3 | — |
| Zinc sulfate | 0-0.8 | — |
| Nitric acid (70%) | 0.01-0.05 | — |
| Sulfuric acid | 0-5 | — |
| NaOH | 0-4 | — |
| KOH | 0-15 | — |
| Carbonate | — | 25-35 |
| 2.0r silicate | 0-20 | 7-15 |
| Sodium hypochloride | 0-8 | — |
| Enzyme system[6] | 0-1 | 0.5-3 |
| 1,2-propanediol | 0-1 | — |
| Boric acid | 0-4 | — |
| Sodium perborate monohydrate | — | 2-6 |
| Calcium chloride | 0-0.5 | — |
| Sodium benzoate | 0.1-6 | — |
| Sodium sulfate | — | 20-35 |
| Water, perfume and other components | Balance to 100% | Balance to 100% |

[1]polyacrylate thickener from ex 3V Co.
[2]linear alcohol ethoxylate from Olin Corporation
[3]sulfonated copolymer of acrylic acid from Alco Chemical Co.
[4]such as those described above
[5]a soil suspending polymer such as those described above
[6]one or more enzymes such as protease, mannaway, natalase, lipase and mixture thereof.

TABLE IV

| Automatic Dishwashing Two-Phase Composition Unit Dose | |
|---|---|
| | Powder (wt % based on 19 g portion) |
| STPP | 34-38 |
| Alcosperse[1] | 7-12 |
| SLF-18 Polytergent[2] | 1-2 |
| Anionically Modified Catechol[3] | 0.1-6 |
| Soil suspending polymer[4] | 0.2-6 |
| Carbonate | 20-30 |
| 2.0r silicate | 5-9 |
| Sodium disilicate | 0-3 |
| Enzyme system[6] | 0.1-5 |
| Pentaamine cobalt(III)chloride dichloride salt | 10-15 |
| TAED | 0-3 |
| Perfume, dyes, water and other components | balance |
| | Liquid (wt % based on 1.9 g portion) |
| Dipropylene Glycol | 35-45 |
| SLF-19 Polytergent[2] | 40-50 |
| Neodol ® C11EO9 | 1-3 |
| Dyes, water and other components | balance |

[1]such as Alcosperse ® 246 or 247, a sulfonated copolymer of acrylic acid from Alco Chemical Co.
[2]linear alcohol ethoxylate from Olin Corporation
[3]such as those described above
[4]a soil suspending polymer such as those described above
[6]one or more enzymes such as protease, mannaway, natalase, lipase and mixture thereof All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising:

(a) a catechol having one or more sulfonate groups; and (b) a water soluble soil suspending polymer selected from saccharide derivatives comprising at least three hydroxy moieties, at least one of the hydroxyl moieties comprising an alkoxy moiety selected from the group consisting of ethoxy, propoxy and butoxy and mixtures thereof, and wherein at least one of the alkoxy moieties has an anionic capping unit, and mixtures thereof.

2. The composition of claim 1 wherein the catechol having one or more sulfonate groups is essentially free of 1,2-benzenediol.

3. The composition of claim 1 wherein the composition comprises from about 0.01% to about 50% by weight of the composition of a surfactant system.

4. The composition of claim 1 wherein the catechol comprises two sulfonate groups.

5. The composition of claim 1 wherein the catechol is present from about 0.0 1% to about 10% by weight of the composition.

6. The composition of claim 1 wherein the composition comprises from about 0.01% to about 10% by weight of the composition of the soil suspending polymer and from about 0.01% to about 50% by weight of the composition of a surfactant system.

7. The composition of claim 6 wherein the composition further comprises a builder.

8. The composition of claim 6 wherein the composition further comprises an enzyme system.

9. The composition of claim 6 wherein the composition further comprises a bleach system.

10. The composition of claim 6 wherein the composition further comprises a chelating agent other than the catechol having one or more sulfonate groups.

11. The composition of claim 1 wherein the composition is in liquid, gel or solid form.

12. The composition of claim 11 wherein the composition is a liquid.

13. A method of removing clay soil from a surface or fabric comprising the steps of:

(a) contacting a composition of claim 1, in neat or dilute form, with the surface or fabric;

(b) rinsing the surface with water.

14. The method of claim 13 wherein the method is undertaken at a temperature of from about 50° C. to about 100° C.

15. A method of removing plant-derived polyphenolic compound soils from a surface comprising the steps of:

(a) contacting a composition of claim 1, in neat or dilute form, with the surface;

(b) rinsing the surface with water.

16. The composition according to claim 1 wherein the alkoxy moiety of the soil suspending polymer is ethoxy.

17. The composition according to claim 16 wherein the anionic capping unit of the soil suspending polymer is sulfate.

18. The composition according to claim 17 wherein the soil suspending polymer is

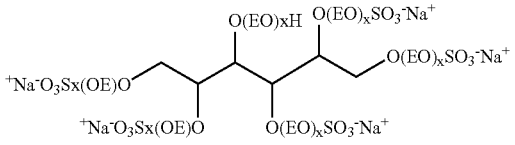

wherein x is from about 1 to about 100.

* * * * *